United States Patent [19]

Landis

[11] Patent Number: 4,819,825

[45] Date of Patent: Apr. 11, 1989

[54] TEAR STRIP CLOSURE WITH IMPROVED TAMPER INDICATION

[75] Inventor: H. Richard Landis, Oak Lawn, Ill.

[73] Assignee: Landis Plastics, Inc., Chicago Ridge, Ill.

[21] Appl. No.: 152,771

[22] Filed: Feb. 5, 1988

Related U.S. Application Data

[63] Continuation-in-part of Ser. No. 927,337, Nov. 5, 1986, Pat. No. 4,732,293.

[51] Int. Cl.[4] ..... B65D 17/40

[52] U.S. Cl. ..... 220/276; 220/270; 220/306

[58] Field of Search ..... 220/276, 270, 306; 215/256, 258

[56] References Cited

U.S. PATENT DOCUMENTS 4,682,706 7/1987 De Vore et al. ..... 220/276

4,732,293 3/1988 Landis ..... 220/276

*Primary Examiner*—George T. Hall

*Attorney, Agent, or Firm*—Fitch, Even, Tabin & Flannery

[57] ABSTRACT

Disclosed is a container and closure assembly including a container having a substantially circular opening and an outer wall containing an upper retention bead and a lower, regularly-outwardly extending security ring. The closure includes a one-piece plastic body having a top panel and an encircling skirt depending from the top panel so as to be integrally attached thereto. The skirt includes a groove for locking engagement with the retention bead to retain the closure on the container. A circumferential line of weakness in the skirt wall defines a removable tear strip having a movable free edge and which is removable from an upper portion of the skirt wall by fracturing the skirt wall along the upper line of weakness. A tear strip is weakened so as to form a plurality of circumferentially-spaced segments throughout the substantial entirety of its periphery. The segments are separable one from another in response to a prying or wedging force applied to the tear strip at the free edge thereof.

20 Claims, 3 Drawing Sheets

TEAR STRIP CLOSURE WITH IMPROVED TAMPER INDICATION

BACKGROUND OF THE INVENTION

This application is a continuation-in-part application of application Ser. No. 927,337 filed Nov. 5, 1986, now U.S. Pat. No. 4,732,293, the disclosure of which is herein incorporated by reference.

This invention relates to a plastic closure which is made inexpensively with injection molding equipment, and more particularly, to closures having a tamper-evident band or tear-off strip which is removed the first time the closure is opened, to provide a tamper-evident feature for the container, and to closures which have a lift-off tab for ease in removing the closure after removal of the tear-off strip.

The present invention is particularly useful with a container which has a security or saturn ring or ledge on the container side wall projecting outwardly of the container side wall at a location immediately below the skirt of the closure to limit access to the lower edge of a tear strip. Because the container security ring projects radially outwardly from the wall of the container and has a larger outer diameter than that of the closure skirt, the security ring protects the strip against accidentally being caught or torn during handling and shipping of the assembled closure and container.

Despite the protection offered by a tamper-indicating tear strip, further improvements in other types of tamper indication are desired, especially if the cost of manufacturing or installing the closure are not increased significantly. In particular, tear strips are typically provided with a snap lock engagement to the container which cannot easily be defeated using normal amounts of force. For example, the container may be provided with a retention bead which cams against a bead or ledge formed on the inside of the tear strip, thereby holding the tear strip and hence the closure, captive on the container. In order to gain entry to the container interior, one must remove the tear strip to disengage the closure skirt from the container. Such removal, however, provides a ready visual indication of the container entry. Those who desire surreptitious entry into such containers may seek to separate the closure and container without removing the tear strip. Tear strips to date have been made with a continuous free edge having significant structural integrity. The security ring, although it provides a certain measure of protection, as mentioned above, may be employed by some to provide support for a pry bar or another instrument used to pry between the security ring and the tear strip (i.e., closure) free edge. Depending upon the type and gauge of the material used to form the closure skirt, the force imparted to the closure by prying against its free edge may, in some instances, be sufficient to dislodge the snap-lock engagement between the closure skirt and container retention bead. It is desirable, therefore, to provide a ready visual indication of this latter, prying-type of surreptitious entry into the container.

SUMMARY OF THE INVENTION

Accordingly, it is a general object of the present invention to provide a new and improved closure for a container, the closure having a tear strip providing at least two modes of tamper indication.

More specifically, it is an object of the present invention to provide a closure having a tear strip engageable with a container, so as to require removal of the tear strip to gain access to the container interior, and the tear strip further providing indication of tampering by attempting to pry the closure from the container without removing the tear strip.

These and other objects and advantages of the present invention, which will become apparent from the following description taken in connection with the accompanying drawings, are provided in a closure for use with a container having a substantially circular opening and an outer wall with a retention bead. The closure has a one-piece plastic body having a top panel and an encircling skirt depending from the top panel so as to be integrally attached thereto. Locking means interlock the skirt with the container retention bead and retain the closure on the container. A removable tear strip with a lower free edge is provided on a lower portion of the skirt and may be removed to indicate that the closure has been opened. A line of weakness in the lower portion of the skirt defines a breakable connection between the tear strip and the skirt. Means are provided for weakening the tear strip so as to form a plurality of circumferentially-spaced weakened segments in the tear strip throughout substantially the entire lower free edge thereof. The weakened segments are separable from one another in response to a prying force applied to the tear strip at the lower free edge thereof, so as to indicate that a prying force has been applied to the closure.

Other objects are provided in an assembly of a closure of the above-described type and a container having a substantially circular opening and an outer wall with a retention bead and a substantially continuous radially outwardly extending security ring on the outer wall. When the closure and container are mated, the locking means on the skirt interlocks with the container retention bead. The closure and container are unlocked by removing of the tear strip which brings the locking means out of interlocking engagement with the retention bead, thereby allowing the closure to brought away from the container opening. However, should a prying force be applied to the lower edge of the closure, that edge adjacent the security ring, one or more segments located at the bottom edge of the tear strip will be separated from the remaining segments of the tear strip so as to disrupt the smooth outer surface thereof, thereby providing a ready, visible and tactile indication that prying force has been applied to the closure. However, the closure of the present invention, providing indication of at least two modes of tampering, including removal of the tear strip and prying against the tear strip, can also be used with containers which do not have a security ring. In this latter example, a prying force could still be applied to the lower edge of the closure, even if the prying force is not developed against the security ring outwardly extending from the container wall.

DETAILED DESCRIPTION OF THE PREFERRED EMBODIMENT

Figure 1:
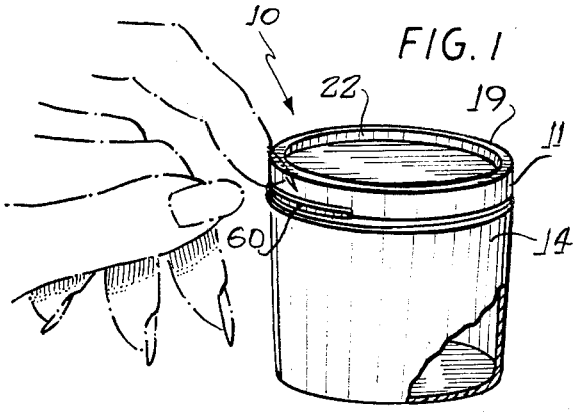
FIG. 1 is a perspective view of a container and closure constructed in accordance with one embodiment of the invention.
Figure 2:
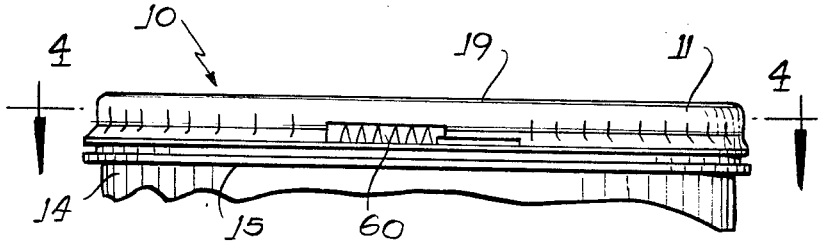
FIG. 2 is an enlarged fragmentary side elevational view of the closure and the top marginal portion of the container.
Figure 3:
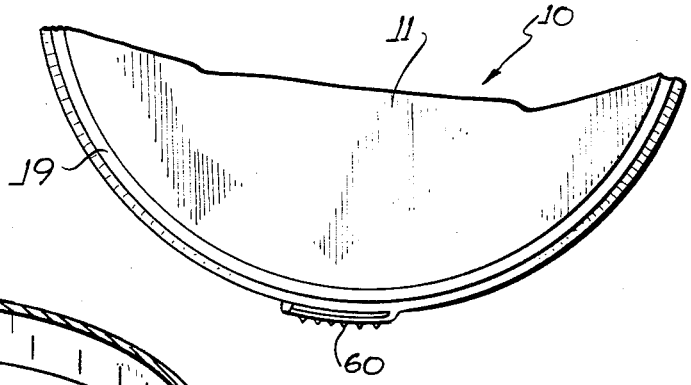
FIG. 3 is a fragmentary plan view of the closure shown in FIG. 2.

As shown in the drawings for purposes of illustration, the invention is embodied in a container 10 having a closure 11 which is press-fitted and snap-fitted on the container, and in sealing engagement to cover the open mouth of the container. The illustrated and preferred container 10 is formed with an integral security ring 12, sometimes called a "Saturn" ring which is an integral projecting ring or flange which projects radially outwardly from a cylindrical wall 14 of the container. The security ring extends generally horizontally from its inner edge (which is connected to wall 14) to an outer peripheral circular edge 15 (see FIGS. 7 and 8).

Figure 7:
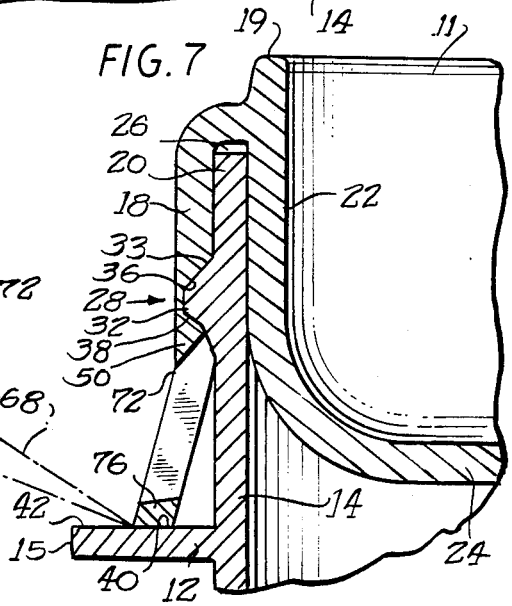
FIG. 7 is a cross-sectional view taken substantially along the line 7—7 of FIG. 6 and looking in the direction of the arrows.
Figure 8:
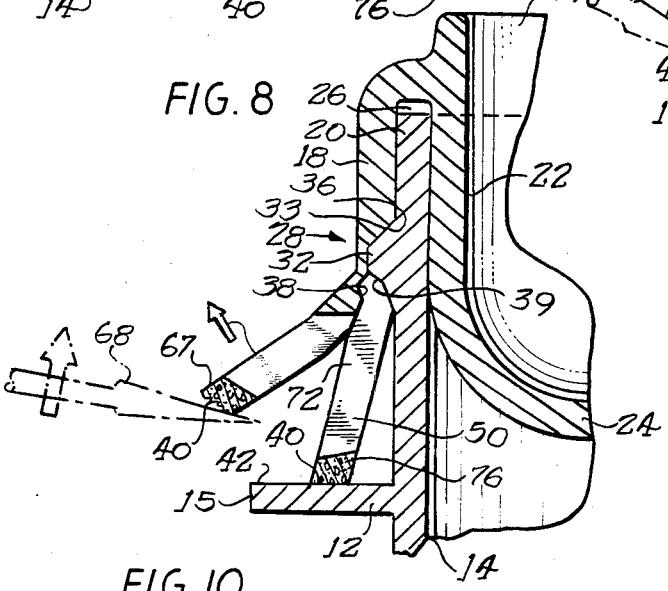
FIG. 8 is a cross-sectional view similar to that of FIG. 7, but showing a skirt segment broken away from the remaining skirt portion.

The closure 11 of the illustrated embodiment is of the plug-type, having an upper edge 19 and a downwardly recessed top circular panel 24, connected to the upper edge by a cylindrical wall 22. When the container and closure are mated, as illustrated in FIGS. 7 and 8, wall 22 overlies a substantial portion of the container wall 14 by an amount which is several times greater than the thickness of either the container or closure members. The closure 11 has a skirt wall 18 which projects downwardly from upper edge 19 and encircles the rim 20 of the container. Stiffening ribs 21 are provided in the preferred embodiment, and extend over portions of the skirt wall outer surface. Such ribs are optional, and may be omitted, if desired.

As illustrated in FIGS. 7 and 8, the rim 20 of the container wall 14 projects upwardly into a generally inverted "U" shaped portion of the closure defined between the skirt 18 and the inverted inner leg or cylindrical wall 22 of the closure which also depends from the closure upper edge 19. The leg 22 is integral with and joins top edge 19 to the top circular panel 24 of closure 11. The skirt 18 and the inner leg 22 are spaced from each other as shown by the space or gap 26. Preferably, the space 26 is slightly narrower than the thickness of rim 20 such that the closure is frictionally retained on the container when the rim 20 is forced between the skirt and the inner leg.

Additionally, engagement of the closure to the container is provided by a snap-fit interlocking means 28 having intermating parts on both the container and closure, which more positively secures the closure to the container until a tamper-proof band 50 is removed. One example of the interlocking means is illustrated in FIGS. 7 and 8, wherein an interlocking means 28 comprises an integral outwardly projecting bead 32 on the container which has an upper, inclined surface 33, which is downwardly sloping (for example, at 45°) so as to cam against the skirt wall 18 as will be described in greater detail hereinafter until an inwardly opening concave recess or groove 36 on the skirt wall 18 is aligned with and has received the bead 32, therein. At such time, a lower shoulder 38 on the skirt at the recess 36 abuts a lower inclined shoulder 39 on the bead 32 to prevent upward lifting movement of the closure from the container. As readily seen in FIGS. 7 and 8, a lower edge 40 of the skirt 18 is disposed immediately above and is preferably in engagement with a top surface 42 of the security ring 12 when the closure is interlocked with the bead on the container.

The security ring 12 will most likely be used in instances where, e.g., where the closure is very flexible, and there is concern that someone could surreptitiously remove the closure by pushing up on the closure to separate it from the container without first tearing off the tamper-evident band 50. In other instances, the person buying the containers may not desire a security ring 12 and may rely instead on the snap-fit engagement of closure to container to hold the closure against someone trying to push against the lower edge 40 of the tamper-evident band 50 so as to push the closure off the container without first removing the tamper-evident band. As will be seen, the present invention, in some of its aspects, provides tamper indication of such pushing and is directed to containers with or without the security ring 12.

According to other aspects of the present invention, the tamper evident band 50 is provided with two different modes of tamper indication, one for indicating removal of the band 50 so as to bring the closure and container out of snap-lock engagement and another for indicating a levering, pushing or prying against the lower closure edge 40, in an attempt to remove the closure 11 intact, without removing band 50.

Figure 4:
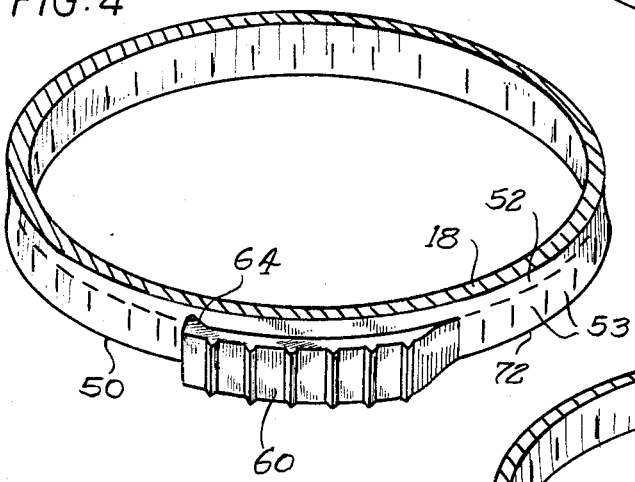
FIG. 4 is a fragmentary perspective view of the lower-skirt portion of the closure, illustrating the tear strip and pull tab portions thereof.
Figure 5:
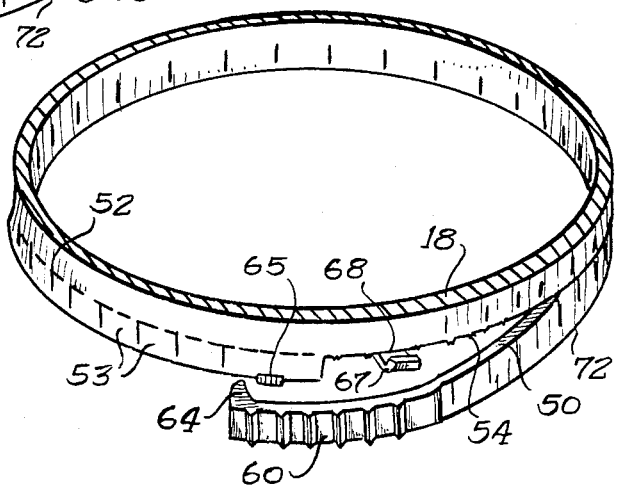
FIG. 5 is a perspective view similar to FIG. 4, but with the pull tab and tear strip partially removed.

Preferably, the dual mode of tamper indication is provided in a one-piece closure, and is compatible with closures such as those having a pull tab 60 joined to the tear strip 50 and which, upon pulling, exposes and makes accessible a lift tab 67 for grasping by the user to lift the closure upwardly from the container. The lift-off tab 67 may, for example, be initially hidden behind the pull tab 60 and can be pulled outwardly to be exposed and accessible after the pull tab is grasped and pulled by the user, as set forth in U.S. patent application Ser. No. 927,337, filed Nov. 5, 1986, which is herein incorporated by reference. Briefly, as described therein, the user can employ fingernail, or tool, to engage and outwardly pry an enlarged knob or free end 64 of the pull tab 60 to break a frangible bridge 65 (FIGS. 4 and 5). Thereafter, further pulling may be relied upon to break any additional frangible bridges such as a bridge located closely adjacent a hinge portion 68 which hinges the enlarged lift portion or lift tab 67 for lifting the closure from the container. As the pull tab 60 swings radially outwardly (as shown in FIG. 5), it pulls the lift tab 67 upwardly and radially outwardly for easy noticeability and ease of grasping by the person desiring to lift off the closure and to have access to the contents of the container. Additional features and advantages of the pull tab, lift tab and tear strip are set forth in the aforementioned U.S. patent application Ser. No. 927,337. In any event, no matter which embodiment of the pull tab is utilized, the tear strip 50 is separated from the remaining, upper portion of skirt wall 18 along a line of weakness 52, which preferably comprises a spaced-apart series of perforations or slots 53. A particular feature of the present invention is the compatibility of the dual mode taper indication according to the present invention with pull tabs and tear strips of the described type.

Referring now to FIGS. 4 and 5, the lower portion of skirt wall 18, that extending below the upper edge 19, is shown in perspective, on an enlarged scale. In particular, the tear strip 50, the line of weakness 52, and an upper portion of skirt wall 18 are shown in FIGS. 4 and 5, and to simplify the illustrations, the leg 22 and top closure panel 24 have not been shown.

Referring now to FIGS. 6–9, tear strip 50 will be described in greater detail. Particular reference will be made herein to the dual-mode tamper indicating features of the tear strip 50. As indicated above, the tear strip is joined to the upper portion of skirt wall 18 by a line of weakness 52. Preferably, the line of weakness 52 comprises a series of spaced-apart perforations 53. When the tear strip 50 is separated from the remaining portion of skirt wall 18, a ragged, unfinished edge 54 at the lower portion of the remaining skirt wall will be formed (see FIG. 5), providing ready indication that the skirt wall has been modified. The inwardly opening concave groove 36 is preferably formed in the upper portion of tear strip 50 and accordingly, removal of tear strip 50 removes the concave recess from its interengagement with the locking bead 32, and the closure 11 can be readily removed from container rim 20. Thus, a first mode of tamper indication is seen to be provided by the preferred embodiment according to features of the present invention.

A second mode of tamper indication, also provided by the same tear strip 50, provides protection against those who may attempt surreptitious entry into the container without removing the tear strip 50. Unauthorized entry may be attempted by prying or wedging the lower edge 40 of the closure to cam the skirt wall 18 in an upward direction, so as to bring the concave recess 36 out of engagement with the locking bead 32. In order to gain such access, a fingernail, and preferably a stronger instrument, such as the screwdriver tip 68, would be placed between the lower edge 40 of closure 11 and the upper surface 42 of security ring 15 as indicated in FIG. 7.

One mode of defeating, or at least indicating such attempts at unauthorized entry may be provided if the skirt wall is made relatively thin to convert the prying force into a flexing movement at the lower edge of the skirt wall, without generating sufficient upward force to break the locking interengagement between the container and its closure. However, with the tamper indication, according to principles of the present invention, the closure can be made of significantly thicker or otherwise stronger material and can thereby provide the structural strength necessary to withstand an automated closing operation in which the closure is forced onto the container rim with a friction and a snap fit. When formed of thinner or more flexible stock, for example, back-up support, may have to be provided for the skirt wall, as the closure is mated to a container rim. With the present invention, however, such back-up can be eliminated, if desired, since the closure, and particularly the skirt wall thereof, can be made of a stronger construction.

Referring again to FIGS. 6–9, closure 11 is illustrated as having a downwardly depending skirt wall 18, as explained above. Preferably, the skirt wall 18 is molded so as to have a continuous, smooth outer surface consisting of an upper, generally cylindrical, surface 70 and a lower, outwardly flared, generally smooth, conical surface 72. In the preferred embodiment, the lower surface 72 corresponds to the outer surface of tear strip 50. The outer surface of the container closure may be formed with a relatively glossy finish, so as to emphasize any irregularities or disruptions in the outer surface. According to one aspect of the present invention, a series of segments 74 are formed in the lower portion of tear strip 50, and preferably extend throughout the entire periphery of the lower, outwardly flared, portion 72. The segments are preferably joined to one another by frangible bridges 76 which may have several different configurations. In general, a prying force applied to the lower edge 40 of the closure will fracture or other break the frangible bridges 76, converting the upward prying force into an outward deflection of the segment or segments 74 to which the leverage force is applied. The outward deflection preferably causes a disruption in the smooth outer surface 72, thereby providing a ready, visible and tactile indication that prying force has been applied to the closure.

Figure 11:
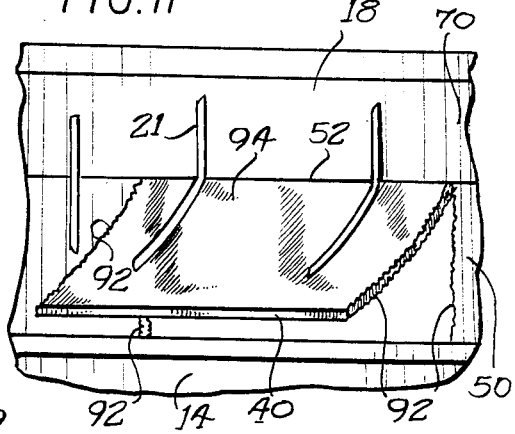
FIG. 11 is a fragmentary cross-sectional view taken along the line 11—11 of FIG. 10 and looking in the direction of the arrows.

Depending upon the type of material from which the closure is formed, the lower portion of the tear strip may, in a variety of ways be prevented from allowing a restoration of its outer, smooth surface 72. For example, referring to FIG. 6, the frangible bridges are formed at the lower edge of the tear strip 50 by perforations 80 which extend in generally axial directions. The perforations 80 stop short of the lower edge 40 of the skirt wall 18 so as to form the frangible bridge 76 therebetween. A levering force applied to the segments will apply a tensile force to the frangible bridges 76, causing their fracturing or breaking. It is generally preferred that the frangible bridges 76 be weakened in an axial direction (i.e., along the length of perforations 80), and preferably in a radially outward direction extending outwardly from the container wall 14. Referring to FIG. 11, as mentioned above, it is generally preferred that the lower end 40 of skirt wall 18 be located immediately adjacent, and preferably in contact with the security ring 12 when the closure is fully mated to the container. A prying instrument such as the screwdriver tip 68 would, initially, have to be inserted between the skirt wall lower end 40 and the security ring upper surface 42, thereby imparting an axially directed or upward force to one or more adjacent frangible bridges 76. Thereafter, upon downward deflection of the screwdriver tip, pressure on the lower end of the skirt wall is resolved into a radially outward and axially upward displacement of the lower skirt portion. This displacement is transmitted adjacent frangible ridges 76, causing their breaking and separation from the skirt wall and at least their permanent stretched deformation, resulting in a disruption of the outer smooth surface 72, thereby providing a ready visual and tactile indication of a prying type of tampering.

According to one aspect of the present invention, it is preferred that the skirt wall be formed from plastic material which is, at least to some extent, ductile under the force of leverage applied to the closure lower end. If made ductile, the plastic will stretch or otherwise elongate as a leverage force is applied, and will be virtually incapable of allowing the stretched portion of the frangible bridge to be shrunk, which would be necessary to restore the outer surface 72 of the lower skirt portion to a smooth surface. Such stretching need not result in a breaking or separation of a frangible bridge, since a disruption will be produced in the outer surface of the skirt wall. If, however, the frangible bridges are stretched to the point of breaking, and if the skirt wall and tear strip are made of suitable ductile material, string-like tail portions 82 drawn from the frangible bridge (see FIG. 9) extend laterally outwardly from the segment edges, effectively preventing an outwardly displaced segment from being forced back into position, flush with adjacent segments which are not outwardly displaced. Again, a readily visual and tactile indication is provided by the disruption in the outer surface of a tear strip portion of the skirt wall.

Figure 6:
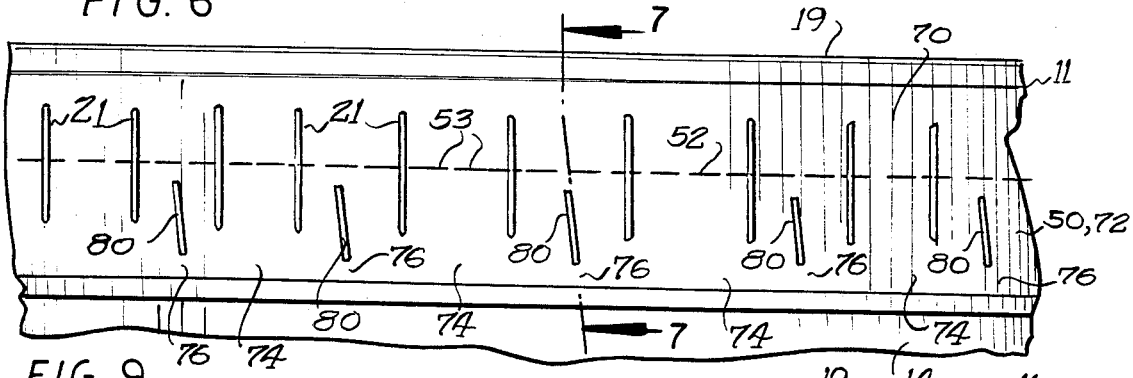
FIG. 6 is a fragmentary side elevational view of the container and closure illustrated in FIG. 2, taken on an enlarged scale.
Figure 9:
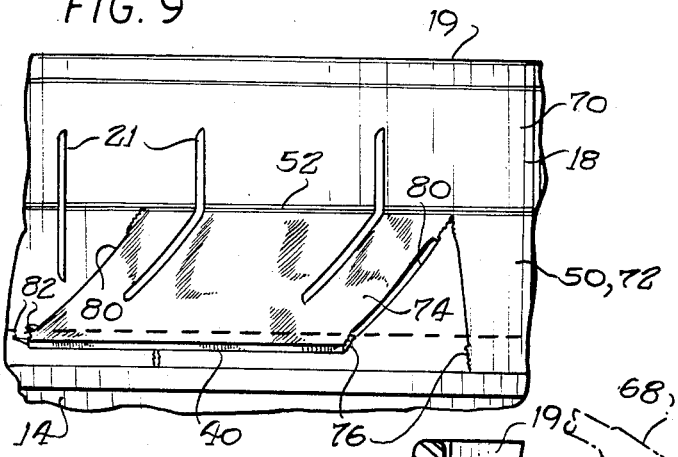
FIG. 9 is a perspective view corresponding generally to FIG. 8, showing a skirt segment broken away from the remaining skirt portion.

As indicated in the preferred embodiment of FIG. 6, perforations 80 are preferably slanted a slight amount in a circumferential direction, inclining the perforations from a true axial direction (i.e., vertical direction as drawn in FIG. 6). This slight angular displacement enhances the initial tearing of the frangible bridges 76 and may also be used to provide frangible bridges of slightly longer length, as compared to perforations which are not angularly inclined.

Figure 14:
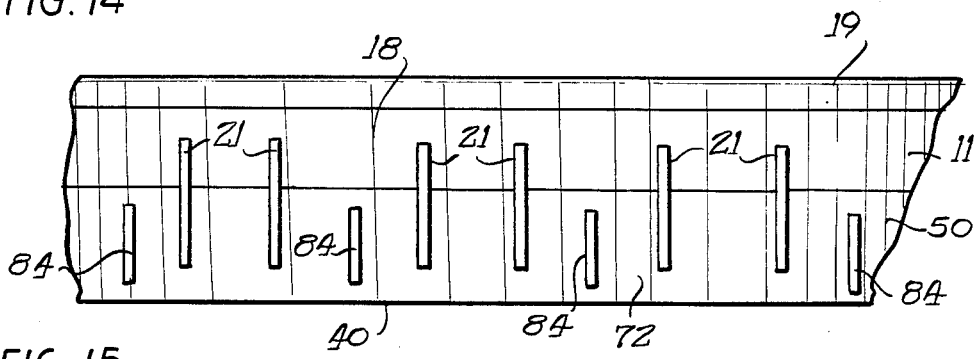
FIG. 14 is a fragmentary elevational view of a closure having an alternative tamper-indicating arrangement according to the present invention.

Referring to FIG. 14, an alternative embodiment of dual mode tamper indication in the closure 11 is illustrated. Perforations 84 are formed in skirt portion 50 and extend parallel to the axis of the container and closure (i.e., in a vertical direction as illustrated in FIG. 14). As with the inclined perforations 80 described above, the width and length of perforations 84 are designed for optimum performance for a closure strip of given dimensions and particular material composition. The optimum performance is that referred to above and would produce a readily perceptible permanent deformation in the outer surface 72 of the skirt wall 18 upon the application of a prying or wedging force to the bottom edge 40 of the skirt wall.

Figure 10:
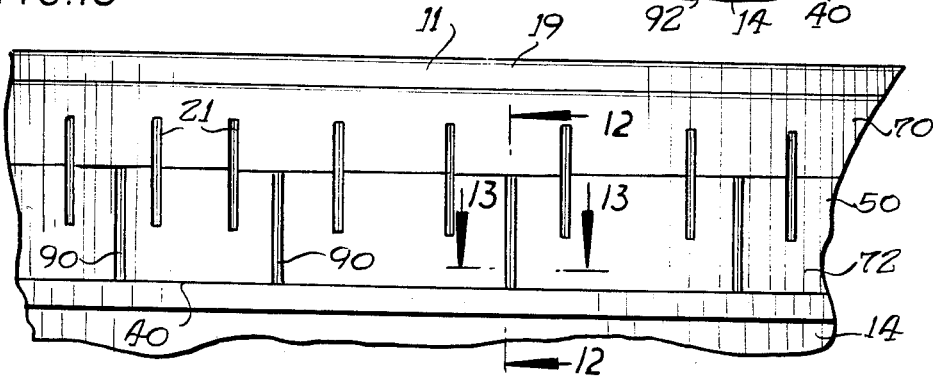
FIG. 10 is a fragmentary elevational view of a closure and upper container rim, showing an alternative embodiment of the tamper-indicating features according to present invention.

Referring now to FIGS. 10–13, tear strip 50 may, according to other principles of the present invention, be weakened in a second manner to provide a ready visual indication of a prying or wedging force applied to the bottom edge 40 of the tear strip. The closure 11 of FIG. 10 is provided with a series of axial grooves 90 inwardly extending from its outer surface 72. As indicated in the cross-sectional view of FIG. 12, grooves 90 in effect reduce the thickness of skirt wall 18, forming a relatively thin frangible bridge 92 extending in an axial direction. The grooves 90 preferably extend from the lower free edge 40 of skirt wall 18 toward the upper end 19 of closure 11. Grooves 90 may be configured to impart any length to frangible bridge 92 that may be desired. In the illustrated embodiment, for example, the grooves 90 and hence the frangible bridges 92, extend from the free edge 40 of skirt wall 18 to the recess 33, and preferably to the line of weakness 52 which joins the tear strip to the upper skirt wall portion.

Figure 13:
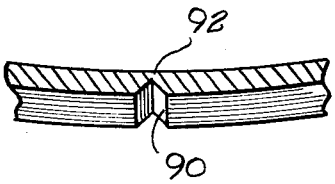
FIG. 13 is a fragmentary, elevational view of a closure having an alternative tamper-indicating arrangement according to the present invention.

Referring to FIG. 13, groove 19 is preferably V-shaped in cross-section, although a concave recess or groove of other configuration could also be used, it may be preferable to form the groove 90 with a width sufficient to permit ready visual inspection of the frangible bridge 92. A user of the product may thereby quickly inspect the frangible bridges for any breaking or bulging which would indicate unauthorized attempts at entry into the container. Referring to FIG. 11, as mentioned above, the frangible bridge 92 preferably extends from the free edge 40 of the skirt wall 18 to the line of weakness 52. Upon the application of a significant prying force to the skirt wall 18, the segment 94 formed between frangible bridges 92 will be struck in an outward direction, being hinged about the line of weakness 52. The line of weakness 52 further weakens the segment 94 by reducing the amount of torque necessary for the outward deflection of the segment 94.

The stiffening ribs 21 illustrated in FIG. 11, for example, may be omitted if desired, so as to provide a minimum resistance of the segment to tearing along the lines of weakness or frangible bridges 92. As indicated above, it is generally preferred that the closure, and especially the skirt wall thereof, be formed of plastic which is ductile and readily drawn upon breaking of the frangible bridges so as to permanently stretch at the point of breaking. As indicated in FIG. 11, it is generally preferred that a ragged extended edge be formed at the point of breaking of the frangible bridge and it is most preferred that the amount of stretching of the broken edge be sufficient to prevent restoration of the outer surface of the tear strip, that is, to allow inward restoring deflection of the segment 94.

Figure 15:
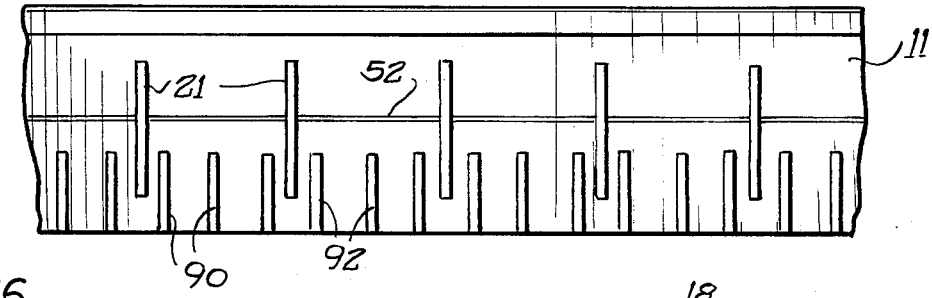
FIG. 15 shows a closure member with alternative tamper-indicating means according to the present invention.

Referring now to FIG. 15, a closure 11 having axially extending grooves 90 is substantially similar to the tamper-indicating means of FIGS. 10–13, except that the grooves are more closely spaced together so as to form a greater number of frangible bridges 92. It is generally desired, however, that the frangible bridges not be provided in so great a number as to detract from a ready visual indication of attempted prying or wedging of the skirt wall.

Figure 12:
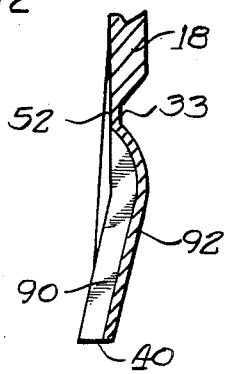
FIG. 12 is a fragmentary, perspective view, shown partially in cross-section, taken generally along the line 12—12 of FIG. 10 and looking in the direction of the arrows.
Figure 16:
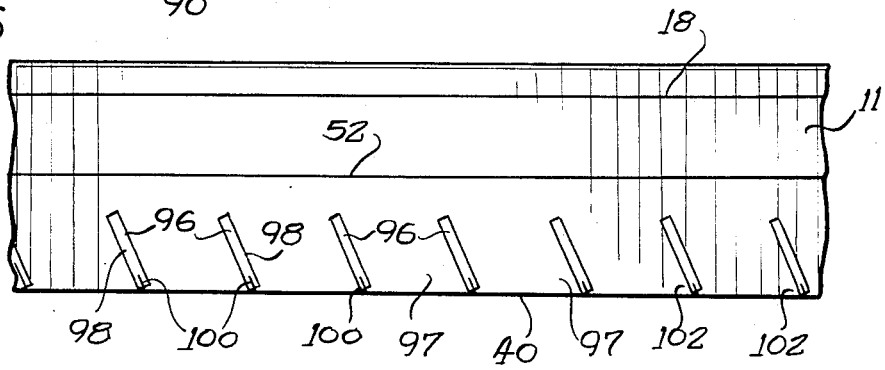

Referring now to FIG. 16, closure 11 is provided with a series of lines of weakness or grooves 96 inwardly extending from an outer surface of the skirt wall in a manner similar to that illustrated in FIGS. 12 and 13. The grooves 96 are inclined in a circumferential direction in a manner described above with reference to FIG. 6, to promote ready initial tearing of the frangible bridges 98 of reduced thickness formed in the bottommost portion or center of each groove 98. To further weaken the frangible bridges and to promote rapid initial tearing thereof, the grooves 96 may be formed with increased depth adjacent the ends thereof adjacent the free edge 40 of the skirt wall. The increased depth may, for example, extend through the full thickness of the skirt wall so as to form slit portions 100 immediately adjacent the free edge 40. The force needed to initiate fracture of the frangible bridges is greatly increased, particularly for prying forces applied to the corners 102 of segments 97 at which an acute angle is formed between the free edge 40 and the groove 96. As illustrated in FIG. 16, grooves 96 form a plurality of weakened segments 97 therebetween. Upon application of a wedging or prying force to the free edge 40 of the skirt wall, the segments 97 are outwardly struck in the manner indicated above, with reference to FIGS. 8 and 11.

It can therefore be seen that a closure for a container has been provided with a tear strip providing ready indication of at least two different modes of tampering. The several embodiments described above have shown examples of closure skirt walls which are weakened to form a plurality of circumferentially-spaced weakened segments in the tear strip. It is generally preferred that the weakened segments extend around the entire circumference of the container closure and extend to the lower free edge thereof. The various weakened segments, as explained, are separable one from another in response to a prying force applied to the tear strip at the free edge of the skirt wall. The weakened segments are preferably formed by weakening the tear strip portion of the skirt wall with line of weakness extending in directions away from a generally circumferential direction, that is, a generally axial direction or at acute angles formed with the axis of the container and closure.

Although only two general means of weakening the segments have been illustrated, a continuous slot as in FIGS. 6–9 or a groove in the outer face of the skirt wall, as in FIGS. 10 and 11, other weakening means may be employed. For example, a series of perforations may extend from the free edge of the skirt wall to the upper edge of the enclosure. As with all embodiments of the segment-forming weakening means, the lines of weakness may extend any desired distance from the free edge of the skirt wall. For example, the lines of weakness may extend to the circumferential line of weakness which joins the tear strip to the remaining portion of the skirt wall, so as to form a hinge for the weakened segments, allowing the segments to be struck out from the skirt wall with lower levels of distorting forces applied by prying or wedging.

Several embodiments of the present invention have been illustrated in conjunction with a container having an outwardly extending security ring. The present invention can, of course, be practiced with containers which do not have security rings, and the present invention is useful for providing a permanent and readily perceptible indication that attempts have been made to pry the closure out of engagement with the sealing bead on the container. For example, for containers without security rings, a screwdriver tip or other prying instrument can be inserted between the container wall and the lower edge of the skirt. Also, while grasping a relatively small size container in both hands, a person may attempt to gain unauthorized entry by applying an upward pressure using his thumbs to push the closure away from the container rim.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A container and closure assembly comprising:

a container having a substantially circular opening and an outer wall with a retention bead and a substantially continuous radially outwardly extending security ring on the outer wall; and a closure including a one-piece plastic body having a top panel, an encircling skirt depending from the top panel so as to be integrally attached thereto, and having a lower edge adjacent the security ring, a locking means on the skirt for interlocking with said retention bead to retain the closure on the container, a removable tear strip having a lower free edge and located on a lower portion of the skirt for removal to indicate that the closure has been opened, means providing a line of weakness in the lower portion of the skirt and defining a breakable connection between the tear strip and skirt, and weakening means for weakening said tear strip so as to form a plurality of circumferentially-spaced weakened segments in the tear strip throughout substantially the entire lower free edge thereof, the segments separable from one another in response to a prying force applied to the tear strip at the lower free edge thereof so as to indicate that a prying force has been applied to said closure.

2. The assembly of claim 1, wherein said tear strip has a relatively smooth outer surface and said weakening means comprise a plurality of frangible bridging means for joining adjacent segments and fracturing in response to a prying force applied to the tear strip free edge so as to allow an outward deflection of at least a portion of said at least one segment whereby the smooth outer surface of said tear strip is disrupted to provide a ready, visible and tactile indication that a prying force has been applied to said closure.

3. The assembly of claim 2 wherein said means for weakening said tear strip comprises at least one perforation defined in said tear strip.

4. The assembly of claim 3 wherein said tear strip defines at least one perforation spaced from the lower free edge thereof.

5. The assembly of claim 2 wherein said frangible bridging means are formed of plastic material which is stretchably tearable so as to be at least slightly elongated in response to the prying force so as to form a tamper-indicating disruption in the outer surface of said tear strip.

6. The assembly of claim 5 wherein said frangible bridging means join adjacent segments in side-by-side relationship and are elongated when broken in response to said prying force so as to prevent the formation of a continuously smooth outer surface in said skirt.

7. The assembly of claim 2 wherein said frangible bridging means extend from a free edge of the tear strip to the line of weakness in the skirt, the line of weakness comprising hinge means swingably mounting said at least one segment for an outward deflection.

8. The assembly of claim 1 further comprising a pull tab integral with the tear strip and located at one end thereof for grasping to tear the tear strip away from the skirt.

9. The assembly of claim 1 further comprising a lift tab connected to the upper portion of the skirt for facilitating removal of the closure after the tear strip has been torn at the line of weakness.

10. The assembly of claim 1 wherein said weakening means comprise generally axially extending lines of weakness formed in said tear strip.

11. The assembly of claim 10 wherein said tear strip has an upper edge formed at the line of weakness and said weakening means extend between the upper edge and lower free edge of said tear strip.

12. The closure of claim 1 wherein said weakening means comprises a plurality of grooves formed in an outer surface of said tear strip each forming a frangible strip of reduced thickness joining adjacent segments and fracturing in response to a prying force applied to the tear strip free edge so as to allow an outward deflection of at least a portion of said at least one request.

13. A closure for use with a container having a substantially circular opening and an outer wall with a retention bead, comprising:

a one-piece plastic body having a top panel;

an encircling skirt depending from the top panel so as to be integrally attached thereto, and having a lower edge positionable adjacent the security ring when the closure is mated to the container;

a locking means on the skirt for interlocking with the container retention bead to retain the closure on the container;

a removable tear strip having a lower free edge and located on a lower portion of the skirt for removal to indicate that the closure has been opened;

means providing a line of weakness in the lower portion of the skirt and defining a breakable connection between the tear strip and the skirt; and weakening means for weakening said tear strip so as to form a plurality of circumferentially-spaced weakened segments in the tear strip throughout substantially the entire lower free edge thereof, the segments separable from one another in response to a prying force applied to the tear strip at the lower free edge thereof so as to indicate that a prying force has been applied to said closure.

14. The closure of claim 13 wherein said weakening means comprise a plurality of frangible bridging means for joining adjacent segments and fracturing in response to a prying force applied to the tear strip free edge so as to allow an outward deflection of at least a portion of said at least one segment.

15. The assembly of claim 14 wherein said frangible bridging means extend from a free edge of the tear strip to the line of weakness in the skirt, the line of weakness comprising hinge means swingably mounting said at least one segment for an outward deflection.

16. The assembly of claim 14 wherein said frangible bridging means are formed of plastic material which is stretchably tearable so as to be at least slightly elongated in response to the prying force so as to form a tamper-indicating disruption in the outer surface of said tear strip.

17. The assembly of claim 16 wherein said frangible bridging means join adjacent segments in side-by-side relationship and are elongated when broken in response to said prying force so as to prevent the formation of a continuously smooth outer surface in said skirt.

18. The assembly of claim 13 wherein said weakening means comprise generally axially extending lines of weakness formed in said tear strip.

19. The assembly of claim 18 wherein said tear strip has an upper edge formed at the line of weakness and said weakening means extend between the upper edge and lower free edge of said tear strip.

20. The assembly of claim 13 further comprising a lift tab connected to the upper portion of the skirt for facilitating removal of the closure after the tear strip has been torn at the line of weakness.

* * * * *